United States Patent [19]

Valiga et al.

[11] 4,362,434

[45] Dec. 7, 1982

[54] PERMANENT DISPOSAL VAULT FOR HAZARDOUS CHEMICAL WASTE MATERIALS

[75] Inventors: Richard E. Valiga, Center Square; John R. Rosso, Mechanicsburg, both of Pa.

[73] Assignee: Stabatrol Corporation, Norristown, Pa.

[21] Appl. No.: 201,498

[22] Filed: Oct. 28, 1980

[51] Int. Cl.[3] ..... B65G 5/00; E02D 31/02

[52] U.S. Cl. ..... 405/128; 405/53; 252/633

[58] Field of Search ..... 405/53, 54, 55, 128, 405/129, 36; 210/170

[56] References Cited

U.S. PATENT DOCUMENTS

| | | | |
|---|---|---|---|
| 3,505,820 | 4/1970 | Draper et al. | 405/53 |
| 3,705,851 | 12/1972 | Brauer | 405/129 X |
| 3,859,799 | 1/1975 | Jaco, Jr. | 405/128 |
| 3,940,940 | 3/1976 | Barrett | 405/54 X |
| 4,166,709 | 9/1979 | Valiga | 405/128 |

FOREIGN PATENT DOCUMENTS

| | | | |
|---|---|---|---|
| 2430371 | 1/1976 | Fed. Rep. of Germany | 405/128 |

*Primary Examiner*—David H. Corbin

*Attorney, Agent, or Firm*—Harry B. Keck

[57] ABSTRACT

A permanent storage vault for hazardous waste materials provides a water-confining basin liner for an excavation basin, a liquid collection system to collect liquids from the basin liner and a double encapsulation for the waste materials including a water-impervious film encapsulation and, surrounding that, an encapsulation of water-impermeable cementitious material. A sump is provided to collect liquids accumulating on the basin liner.

8 Claims, 6 Drawing Figures

PERMANENT DISPOSAL VAULT FOR HAZARDOUS CHEMICAL WASTE MATERIALS

BACKGROUND OF THE INVENTION

1. Field of the Invention

This invention relates to permanent disposal vaults for hazardous chemical waste materials and more particularly to vaults which provide for continuous monitoring of liquid leakage and leachates.

2. Description of the Prior Art

Heretofore hazardous chemical waste materials have been permanently encapsulated in concrete vaults which have been formed in situ below the surface of the surrounding terrain. Hazardous chemical waste materials have been deposited in bulk or in distinct containers (e.g., metal drums) in a concrete basin and subsequently covered with water-impermeable permanent materials such as a covering layer of poured-in-place concrete. If any breakage occurs in the basin or in the covering material, surface water can penetrate the concrete, soak the waste materials and form a reservoir of hazardous leachate which tends to escape from the concrete basin into the local geological strata whence contamination of natural water systems can develop. It is desirable to dispose of hazardous chemical waste materials in some fashion which will preclude entry of leakages and leachates into the natural water distribution system. It is further desirable to dispose of hazardous chemical waste materials in some fashion which will permit positive identification of leakage materials and leachate materials if any should develop within the hazardous chemical waste disposal area.

NOTE: Hazardous chemical waste materials are to be distinguished from active biological waste materials (sewage, garbage, trash—sometimes called "municipal wastes") and radioactive wastes (sometimes called "nuclear wastes"). This invention is not intended for active biological wastes or radioactive wastes.

BRIEF DESCRIPTION OF THE INVENTION

According to the present invention, a permanent disposal vault for hazardous chemical waste materials is provided in a generally sloping terrain by providing an excavation basin which may be below, above or coincident with the existing sloping surface grade of the region and preparing the excavation basin for receiving hazardous chemical waste materials in the following fashion. The excavation basin is covered with a basin liner which may be a water-impervious continuous film or a cementitious water-impermeable coating. The basin liner extends beyond the upper rim of the excavation basin. A water collection system is installed on top of the basin liner. The water collection system has multiple openings for receiving accumulated liquids and delivering the accumulated liquids through an outlet conduit which extends beyond the rim of the excavation basin. The outlet conduit communicates with a monitoring sump which is positioned outside the excavation basin and is at least in part below the bottom surface of the excavation basin. A first layer of water-permeable filler material is applied on top of the basin liner and extending above the liquid collection system. A first covering of water-impermeable cementitious material is applied as a monolithic layer over the first layer of water-permeable material. Then a first water-impervious continuous film is applied on top of the first water-impermeable cementitious layer. A second layer of water-permeable filler is applied above the first water-impervious continuous film. This second layer of water-permeable filler constitutes a floor for the vault to receive hazardous waste materials. The hazardous chemical waste materials can be introduced into the basin in bulk or in suitable containers. After the hazardous chemical waste material is introduced into the basin or into a portion of the basin, the hazardous chemical waste materials are covered with a second water-impervious film which is joined along its perimeter to the first water-impervious film. A third layer of water-permeable filler material is applied on top of the second water-impervious film. A second layer of water-impermeable cementitious filler is applied thereafter joining at its perimeter with the perimeter of the first layer of water-impermeable cementitious filler. A third water-impervious film is applied above the second layer of water-impermeable cementitious filler and is joined at its periphery to the periphery of the basin liner. Two additional layers of water-permeable filler are sequentially applied above the third water-impervious film at a level above the terrain surface in the region to complete the permanent vault.

In the described hazardous chemical waste material vault, any liquid leakage or leachate from the hazardous chemical waste materials is confined by a water-impervious film envelope and a surrounding water-impermeable cementitious layer envelope. The encapsulated vault is positioned above a suitably lined excavation basin. A liquid collection system is provided to collect any liquid leakage or liquid leachate which might penetrate the encapsulated vault and accumulate on the basin liner. The liquid leakage or leachate is confined and can be collected in a sump and thereby does not enter indiscriminately into the natural water distribution system of the region. The liquid content of the sump can be analyzed to determine the precise nature of the leakage or leachate and to identify the scope of the hazard, if any, which might be created by the liquid leakage or leachate. The vault also provides a reliable means for determining promptly any failure of the integrity of the permanent vault and permits corrective measures to be undertaken promptly before any serious contamination of the natural water distribution system of the region can occur.

DESCRIPTION OF THE PREFERRED EMBODIMENTS

Figure 1:
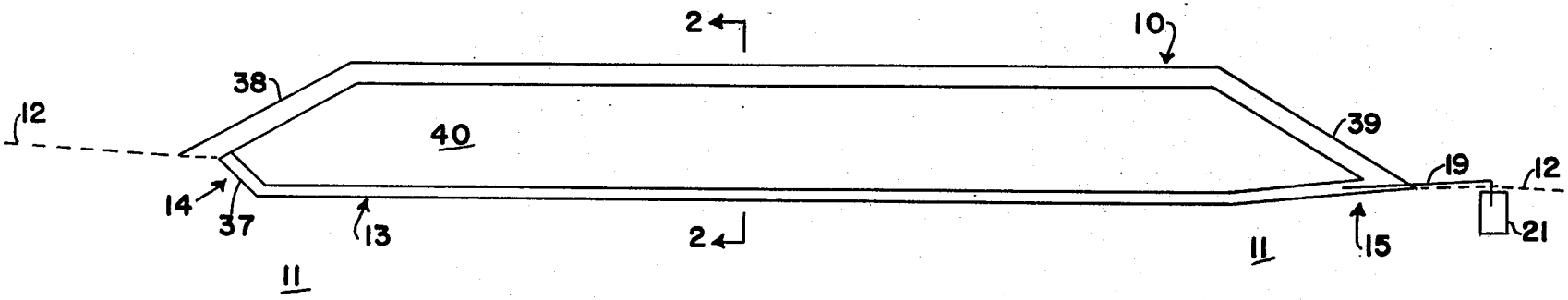
FIG. 1 is a sectional view taken through a hazardous chemical waste disposal unit.

A waste disposal unit 10 as shown in FIG. 1 is established in a region 11 having a generally sloping surface 12. An excavation basin 13 is established in the region 11 in a size sufficient to accommodate the anticipated waste disposal requirements. An economical size unit might be 800 feet long, i.e., from the upper end 14 to the lower end 15. The excavation basin 13 may be above, below or coincident with the sloping surface 12. The bottom of the excavation basin should be located significantly above the high water table level of the region. Where possible, the excavation basin 13 is cut into the sloping surface 12. However, it may be necessary to construct a plateau of naturally occurring earth materials above the sloping surface and to form the excavation basin 13 in the plateau. The slope of the surface 12 from the upper end 14 to the lower end 15 should be between 2 percent and 15 percent.

Figure 2:
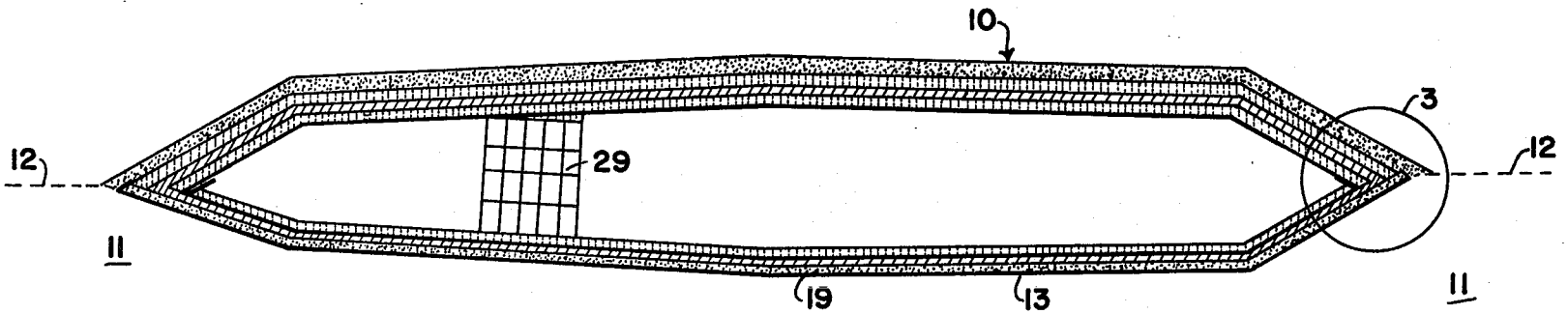
FIG. 2 is a sectional view taken along the lines 2—2 of the hazardous chemical waste disposal unit of FIG. 1.

The excavation basin 13 has an economical width as shown in FIG. 2 of perhaps 100 feet to 200 feet. Waste disposal units which are too small are economically ineffective. Waste disposal units which are too large may require excessive time for completion of the unit.

Figure 3:
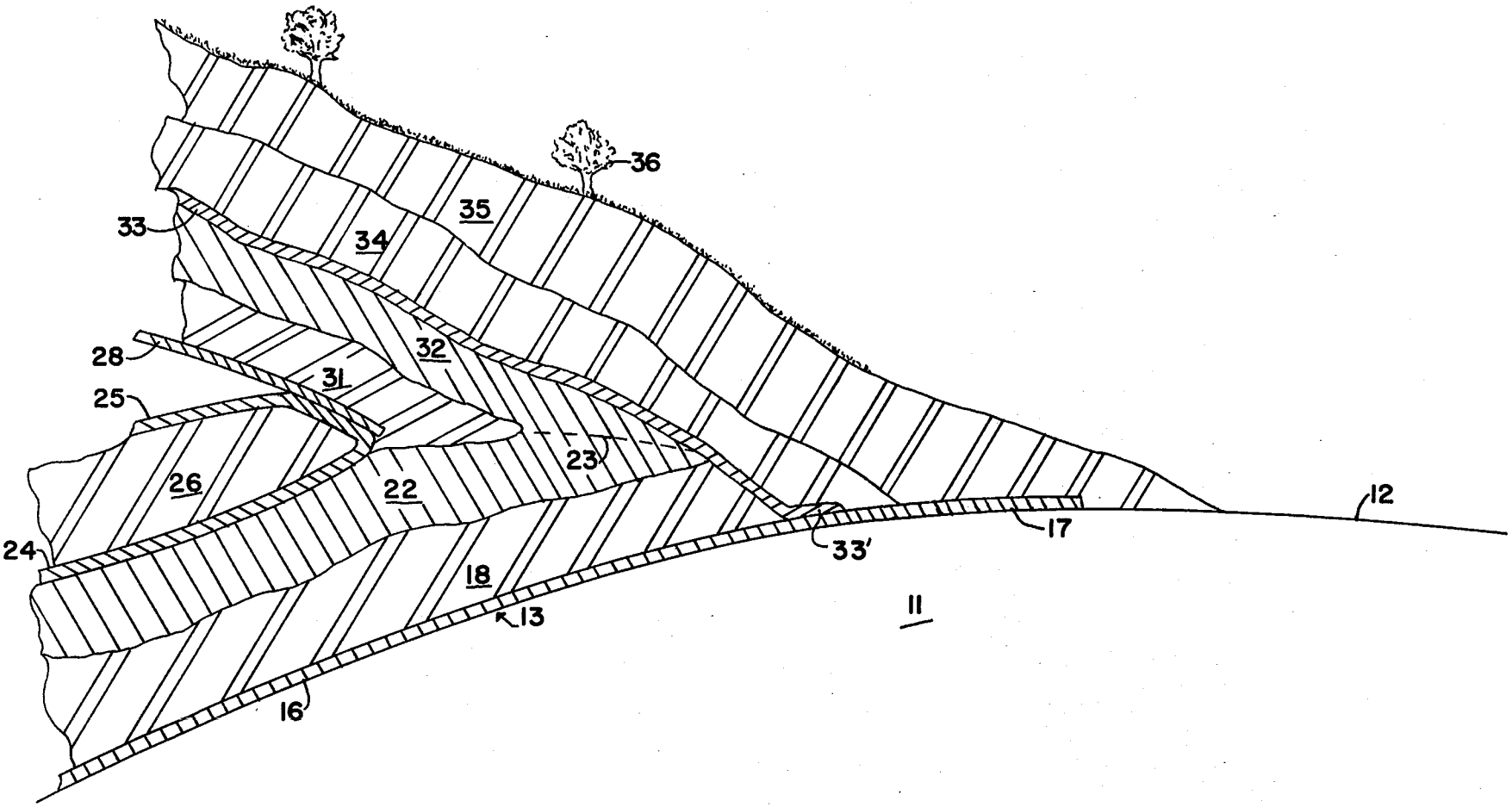
FIG. 3 is an enlarged detail of the perimeter of the unit—an enlargement of the encircled area 3 of FIG. 2.

The excavation basin 13 is covered with a basin liner which preferably is a continuous water-impervious pliable film 16 which covers the excavation basin 13 and includes a perimeter strip 17, shown in FIG. 3 in phantom outline, extending over the perimeter edge of the sloping surface 12. After the basin liner film 16 is applied over the entire excavation surface, a first water-permeable layer 18 is applied by compacting local earth materials such as gravel, rocks, sand, clay and the like. In a typical waste disposal unit, the first water-permeable layer 18 will have a depth of about 12 inches.

The basin liner preferably is a continuous film 16 where the hazardous chemical wastes are aqueous and will not soften, extract, dissolve or deteriorate the plastic material of such films. Such films may be preformed films of polyethylene, polypropylene, polyethylene terephthalate, polyvinyl chloride, polyvinyl fluoride or sprayed-on organic materials such as asphalts. If the hazardous chemical wastes contain organic contaminants which might cause deterioration of an organic film (with consequent leaching of the contaminant or dissolved film below the excavation basin 13) then the basin liner should be a cementitious water-impermeable layer 6 to 12 inches thick of suitable cementitious substances and fillers to be hereinafter more fully described.

Figure 4:
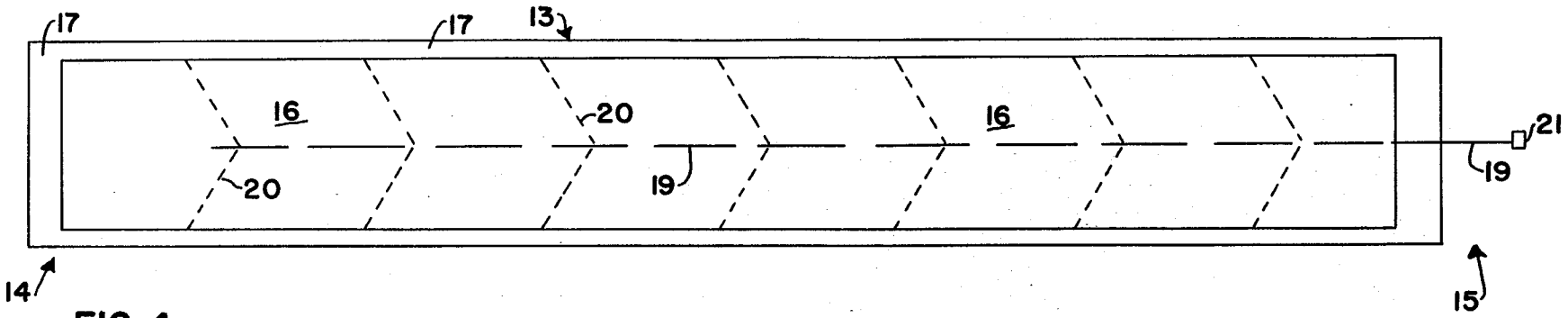
FIG. 4 is a plan view of a hazardous chemical waste disposal unit according to this invention.

Prior to introducing the first water-permeable layer 18, a liquid collection system is applied over the top of the basin liner, i.e., the first impervious film 16 as shown in FIG. 4. The liquid collection system includes a manifold conduit 19 which extends from the upper end 14 past the lower end 15 of the excavation basin 13 and multiple feeder conduits 20 which are perforated piping, for example, 4-inch diameter perforated polyvinyl chloride pipe. The manifold conduit 19 extends past the bottom end 15 of the excavation basin to an appropriate monitoring sump 21 which is at least in part below the level of the excavation basin 13, as better seen in FIG. 1.

The first water-permeable layer 18 functions in the manner of a drain to permit any liquid materials to permeate and enter into the perforated feeder conduits 20 for collection in the manifold conduit 19 and accumulation in the sump 21.

The water-permeable layer 18 normally will be compacted by suitable earth compacting equipment such as sheepfoot rollers.

As shown in FIG. 3, the first water-impermeable cementitious layer 22 is applied over the first water-permeable layer 18 to a perimeter indicated by the broken line 23.

The water-impermeable cementitious layer 22 may be fabricated from concrete or from mixtures of Portland cement with fillers such as natural earth materials from the region, fly ash, slag and even chemical waste materials. In a preferred embodiment, the first water-impermeable cementitious layer 22 is formed by mixing in situ a supply of Portland cement with inert filler substances by dragging a disc harrow over alternate layers of the Portland cement and the inert particulate fillers. The resulting mixture of Portland cement and inert fillers can be compacted with conventional earth moving equipment such as a sheepfoot roller. Thereafter a first water-impervious film 24 is applied as a continuous film over the top of the first water-impermeable cementitious layer 22. The perimeter 25 (shown in phantom outline in FIG. 3) of the first water-impervious film 24 extends to the perimeter 23 while the vault is being constructed. A second water-permeable layer 26 is applied and compacted on top of the first water-impervious film 24. Thereafter the perimeter 25 is folded back over the perimeter of the second water-permeable layer 26.

The second water-permeable layer preferably has a thickness of 8 to 20 inches; a 12-inch thick layer is recommended.

In this condition, the waste disposal unit 10 is ready for receiving hazardous chemical waste materials. The second water-permeable layer 26 functions as a floor for the storage unit. The second water-permeable layer 26 prevents unintended penetration or abrasion of the first water-impervious film 24 during the period when the waste disposal unit is receiving waste materials.

Figure 5:
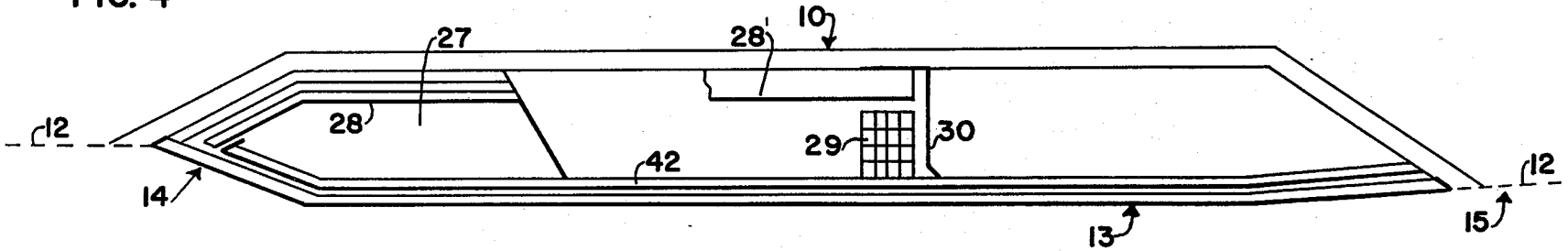
FIG. 5 is a sectional view similar to FIG. 1 showing progression methods for filling a single disposal unit with different types of hazardous chemical waste substances.

The waste materials may be introduced into the waste disposal unit in bulk form by belt conveyors, by trucks, by bulldozers and other earth moving equipment. Alternatively, the waste materials may be introduced into the storage unit in containers such as metal drums, plastic drums, fiber drums and the like. As shown in FIG. 5, the waste disposal unit 10 may receive some waste material 27 in bulk form. In this instance, the waste material 27 will be covered with a second water-impervious film 28 which will join the perimeter 25' of the first water-impervious film 24. Alternatively, the waste material may be stacked in suitable containers 29 (FIG. 5) which are similarly covered with a second water-impervious film 28'.

As the waste disposal unit 10 is filled from its upper end 14 toward its lower end 15, a temporary water-impervious film 30 will be applied to cover the most recent waste material. The temporary cover keeps atmospheric moisture and wind currents from disturbing the accumulated waste materials 27, 29.

When the waste disposal unit 10 is filled to the satisfaction of the operator, the accumulated waste material is covered as shown in FIGS. 2 and 3. The second water-impervious film 28 is joined at its perimeter to the perimeter 25 of the first water-impervious film 24 whereby the two films 28, 24 comprise a total encapsulation film of water-impervious material for the hazardous waste materials. A third water-permeable layer 31 is applied above the second water-impervious film 28. Thereafter a second water-impermeable cementitious layer 32 is applied above the water-permeable layer 31 and connects with the first water-impermeable cementitious layer 22 along the perimeter 23. The first and second water-impermeable layers 22, 32 constitute a monolithic composition and thus form a water-impermeable encapsulation of the film-encapsulated waste materials.

A third water-impervious film 33 is applied above the second water-impermeable layer 32 to serve as a watershed for surface water. The third water-impervious film 33, at its periphery 33', joins the basin liner 16 at the perimeter strip 17. Thereafter a fourth water-permeable layer 34 is applied above the second water-impermeable cementitious layer 32.

Finally, a fifth water-permeable layer 35, preferably topsoil, is applied on top of the fourth water-permeable layer 33 and the sloping surface 12 of the region 11 whereby the region 11 is restored to an aesthetically satisfactory surface contour. Vegetation 36 is established on the exposed surface of the fifth water-permeable layer 35.

The water-impervious films 16, 24, 28, 33 preferably are 6 mil thickness polyethylene continuous films although other plastic films are useful, for example, polyvinyl chloride, polyvinyl fluoride, polyethylene terephthalate, polypropylene and other pliable film materials. The first, second, third and fourth water-permeable layers 18, 26, 31, 33 preferably are compacted earth materials which are locally obtained in the region 11. The thickness of these layers is optimally about 12 inches although thicknesses from 6 to 30 inches can be considered.

The fifth water-permeable layer preferably is topsoil about 24 inches thick to accommodate adequate rooting and growth of vegetation 36.

Referring to FIG. 2, it will be observed that the manifold conduit 19 (shown in cross-section) is disposed along a low level of the excavation basin 13. The bottom surface of the excavation basin 13 slopes from its sides toward the manifold conduit 19 at a slope of at least 1 percent over the major portion of the bottom of the excavation basin 13.

The manifold conduit 19 should be at least 5 feet above the high water table level in the region 11 to preclude ground water entry upwardly into the waste disposal unit 10.

The monitoring sump 21 has a capacity of 50 to 500 gallons and is, at least in part, below the bottom surface of the excavation basin 13.

Referring to FIG. 1, the excavation basin 13 has a sharp upper slope 37 at its upper end 14. This slope can be from 10 to 30 percent, sufficient to establish the excavation basin 13 in a short distance. The surface grading of the disposal unit 10 as shown in FIG. 1 is preferably about 8 percent at the upper end 14 along the surface 38. The lower slope 39 of the contoured surface can have a slope of 10 to 20 degrees, approximately 17 percent slope being preferred. The height of the encapsulated waste disposal vault 40 (FIG. 1) can range from about 10 to 30 feet. Heights of about 16 feet are preferred.

The sloping surface 12 should be provided with a diversion swale 41 which is simply a trench cut into the existing contour of the sloping surface 12 to provide a diversion path for surface waters around the waste disposal unit 10, thereby minimizing the seepage of ground water into the region of the waste disposal unit 10.

After the present waste disposal unit has been sealed as herein described, the contoured surface is aesthetically pleasing and the waste materials are permanently encapsulated in a vault from which there is little likelihood of leakage or leaching of hazardous chemical wastes into the natural water distribution system. This results from the fact that the encapsulated materials are protected from ingress of moisture and hence there is no tendency for leaching or leaking to occur. If some leakage or leaching does occur, the resulting leakage will be trapped within a flow zone of water-permeable materials (the first water-permeable layer 18) and will be collected on the excavation basin liner, i.e., on the water-impervious film 16 for accumulation within the water collection system of manifold conduit 19 and feeder conduits 20. The leakage or leachate will collect in the monitoring sump 21. Samples of the leachate can be analyzed to determine promptly the nature of the leakage or leachate. Moisture sensors can be employed to detect any loss of integrity in the encapsulation system.

Figure 6:
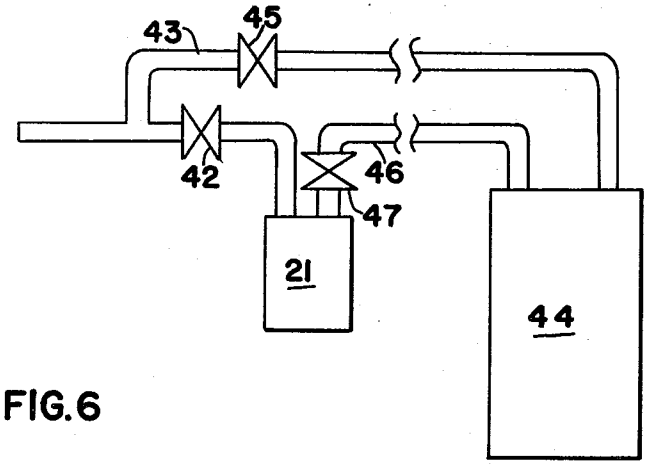
FIG. 6 is a schematic illustration of a liquid collection system which is provided in the preferred embodiment of the invention.

As shown in FIG. 6, the collection conduit 19 connects directly with the monitor sump 21 through a normally open valve 42. A bypass conduit 43 joins the collection conduit 19 to a large collection tank 44 through a normally closed valve 45 which may be remote from the monitor sump 21. A conduit 46 may be provided to connect the monitor sump 21 to the large collection tank 44 through a valve 47. Thus excess liquid accumulations may be collected in the tank 44 by flowing through the monitor sump 21 and conduit 46 or by bypassing the monitor sump 21 through the conduit 43. If the periodic sampling of the contents of the monitor sump 21 indicates that a leak has occurred in the encapsulation vault, the liquid drainage can be disposed of effectively according to the nature of the contaminants. For example, the liquid may be absorbed in local earth materials and deposited as waste in a different permanent waste disposal vault in the same region. This feature provides a closed-loop containment system for correcting any faults which may develop in the vault.

The cementitious water-impermeable material which is employed in the present permanent vaults is preferably produced in situ by combining three ingredients: a cementitious additive such as Portland cement, inert fillers such as indigenous earth materials (stone, gravel, clay, sand, rocks, soil) and a moisture-containing material such as water, aqueous slurries containing suspended finely divided solids, or semiliquid sludges. The three ingredients are applied to the surface where the cementitious layer is to be located and are mixed in situ by appropriate mechanical mixing devices such as an agricultural disc harrow. The preparation of cementitious layers in this fashion is described in copending U.S. patent application Ser. No. 165,280 filed July 2, 1980, and assigned to the assignee of the present application. In addition to Portland cement as the cementitious ingredient of the cementitious filler, it is possible to use calcium oxide, calcium sulfate hemihydrate, anhydrous calcium sulfite, other hydraulic cements. An inert particulate filler which is useful in preparing the cementitious layer is fly ash obtained from industrial processes. In general, the thickness of the cementitious layers of this permanent vault are from 6 to 18 inches thick, preferably about 12 inches thick.

The basin liner may be a water-impervious preformed film of plastic material as herein described, may be a layer of cementitious water-impermeable material, particularly where organic contaminants are to be confined within the permanent disposal vault. Where the cementitious water-impermeable layer is employed as the basin liner, the upper surface of that cementitious layer may be sprayed with a film of heavy oil such as MC-30 oil.

We claim:

1. A permanent storage vault for hazardous wastes comprising:

an excavation basin below the existing sloping surface grade of the region selected for the said vault, said excavation basin having a bottom surface which is above the high water table of the region, and having a rim which corresponds with the existing surface grade of the region, said rim including an upper rim end and a lower rim end;

a basin liner comprising a means for confining liquids applied to the excavation basin and extending beyond the said rim;

a liquid collection means applied above said basin liner, said liquid collection means having liquid collection openings at plural locations over the said basin and having an outlet conduit extending beyond the said lower rim of the said excavation basin;

a first layer of water-permeable filler material covering the said liquid collection means and said basin liner;

a monitoring sump located outside the said excavation basin and at least in part below the said bottom surface of the said excavation basin, said outlet conduit being connected to drain liquid into said monitoring sump;

a first layer of water-impermeable cementitious filler applied over the top of said first layer of water-permeable filler as a monolithic composition;

a first water-impervious continuous film applied over said first layer of water-impermeable cementitious filler;

a second layer of water-permeable filler applied above said second water-impermeable filler and serving as a floor for receiving waste materials;

waste materials applied above said second layer of water-permeable filler;

a second water-impervious film applied over said waste materials and having its perimeter joining the perimeter of the said first water-impervious film;

a third layer of water-permeable filler applied to the top of said second water-impervious film;

a second layer of water-impermeable cementitious filler applied as a monolithic composition over the said third layer of water-permeable filler, and connecting at its perimeter with the perimeter of said first layer of water-impermeable cementitious filler;

a third water-impervious film applied to the top of the said second layer of water-impermeable cementitious filler and joining at its periphery with the said basin liner;

a fourth layer of water-permeable filler applied above the said second layer of water-impermeable cementitious filler;

a fifth layer of water-permeable filler applied above the said fourth layer of water-permeable filler; said fifth layer extending beyond the said rim of said excavation basin and being graded at its perimeter to accommodate the existing surface grade of the region.

2. The vault of claim 1 wherein the waste materials are deposited into said excavation basin in bulk and are compacted and covered with a portion of said second water-impervious continuous film.

3. The vault of claim 1 wherein said waste materials are introduced into said excavation basin in individual containers which are covered with a portion of said second water-impervious continuous film.

4. The vault of claim 1 wherein the said waste materials are in part introduced into said basin as a bulk material which is compacted and covered with a portion of the said second water-impervious continuous film and in part introduced in separate containers which are covered with a further portion of said second continuous water-impervious film.

5. The vault of claim 1 wherein the said basin liner is a continuous film of water-impervious pliable plastic material.

6. The vault of claim 5 wherein the said film is a preformed film of organic plastics.

7. The vault of claim 1 wherein the said basin liner is a layer of water-impermeable cementitious material.

8. A vault for permanent storage of waste materials comprising a water-impermeable basin having a water-confining basin liner and an enclosed drainage collection system which is above the high water table of the region where the vault is located;

waste materials within said excavation basin;

a water-impervious encapsulation film for said waste materials;

a monolithic water-impermeable encapsulation for the said encapsulation film;

a covering for said vault being contoured to accommodate the existing surface grades, said covering extending above the existing surface grade;

a monitoring sump for liquid drainage;

conduit means connecting said drainage collection system to said monitoring sump for delivering liquids from said basin liner.

* * * * *